US011708810B1

(12) United States Patent
Nagaraja et al.

(10) Patent No.: US 11,708,810 B1
(45) Date of Patent: Jul. 25, 2023

(54) FUEL SYSTEM AND ENGINE HEAD ASSEMBLY HAVING DOUBLE-WALLED FUEL CONNECTOR FOR COOLING FUEL RETURN

(71) Applicant: Caterpillar Inc., Peoria, IL (US)

(72) Inventors: Manjunath Bannur Nagaraja, Naperville, IL (US); Zhenyu Li, Peoria, IL (US); Benjamin R Tower, Varna, IL (US); Aniket Suresh Dighe, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/745,970

(22) Filed: May 17, 2022

(51) Int. Cl.

| | |
|---|---|
| ***F02M 53/04*** | (2006.01) |
| ***F02M 55/02*** | (2006.01) |
| ***F02M 47/02*** | (2006.01) |
| ***F02M 37/00*** | (2006.01) |

(52) U.S. Cl.
CPC ..... *F02M 53/043* (2013.01); *F02M 37/0017* (2013.01); *F02M 37/0052* (2013.01); *F02M 47/027* (2013.01); *F02M 55/02* (2013.01); *F02M 2700/077* (2013.01)

(58) Field of Classification Search
CPC ..... F02M 37/0017; F02M 37/0052; F02M 47/027; F02M 53/043; F02M 55/02; F02M 2700/077
USPC ..... 123/41.42, 468, 514, 541
See application file for complete search history.

(56) References Cited

U.S. PATENT DOCUMENTS

| | | | | |
|---|---|---|---|---|
| 5,143,039 | A * | 9/1992 | Gmelin | F02M 69/465 123/456 |
| 5,803,051 | A * | 9/1998 | Stehr | F02M 53/00 123/456 |
| 6,338,334 | B1 * | 1/2002 | Ando | F02M 35/10216 123/456 |
| 6,708,481 | B2 | 3/2004 | Kamen | |
| 7,021,558 | B2 | 4/2006 | Chenanda | |
| 7,370,639 | B2 * | 5/2008 | Jung | F02M 35/10216 123/456 |
| 2004/0200457 | A1 * | 10/2004 | Gottemoller | F02M 55/002 123/468 |
| 2005/0188961 | A1 * | 9/2005 | Devall | F02M 31/205 123/541 |

(Continued)

FOREIGN PATENT DOCUMENTS

| | | | |
|---|---|---|---|
| CN | 106121886 | A | 11/2016 |
| DE | 3141070 | A1 | 4/1983 |

(Continued)

*Primary Examiner* — Erick R Solis
(74) *Attorney, Agent, or Firm* — Brannon Sowers & Cracraft PC

(57) ABSTRACT

An engine head assembly includes a double-walled fuel connector assembly in an engine head and forming a high-pressure fuel supply passage and a low-pressure fuel return passage. The engine head assembly also includes a fuel injector. A high-pressure fuel inlet path extends between a fuel inlet and spray orifices through an injector body in the fuel injector. A low-pressure cooling fuel outlet path extends between an injection control valve seat in the fuel injector and a cooling fuel outlet in a nozzle case of the fuel injector. Expelled cooling fuel is passed through the low-pressure fuel return passage in the double-walled fuel connector.

20 Claims, 3 Drawing Sheets

(56) References Cited

U.S. PATENT DOCUMENTS

| | | | | |
|---|---|---|---|---|
| 2006/0236979 | A1* | 10/2006 | Stolarz | B60K 15/01 123/468 |
| 2014/0000562 | A1* | 1/2014 | Eklund | F02M 55/002 123/447 |
| 2017/0045023 | A1* | 2/2017 | Koi | F02M 61/18 |

FOREIGN PATENT DOCUMENTS

| | | | | |
|---|---|---|---|---|
| EP | 1150006 | A2 * | 10/2001 | F02M 55/002 |
| EP | 1469188 | A1 * | 10/2004 | F02M 55/002 |
| JP | 2010038000 | A | 2/2010 | |

* cited by examiner

FUEL SYSTEM AND ENGINE HEAD ASSEMBLY HAVING DOUBLE-WALLED FUEL CONNECTOR FOR COOLING FUEL RETURN

Technical Field

The present disclosure relates generally to a fuel system, and more particularly to dissipating heat of a fuel injector to cooling fuel expelled through a double-walled fuel connector assembly.

Background

The fuel system for a modern internal combustion engine is commonly one of the most complex and expensive parts of the overall system. A typical fuel system includes multiple pumps, filters, fuel lines, sensors, and fuel injectors each having a number of rapidly moving and sensitive components to precisely and reliably inject a fuel. In a compression-ignition engine application fuel injectors are typically positioned to inject fuel at high pressure directly into individual engine cylinders. Fuel systems, and notably fuel injectors themselves, are typically subjected to relatively high temperatures and temperature ranges. Electronic and hydraulic components of fuel injectors can be relatively temperature sensitive.

It has long been recognized that fuel systems can operate differently depending upon ambient temperatures, engine temperatures, and specifically the temperature of the fuel that is injected and often used to actuate injector components. During cold conditions, for example when an engine is first started after being turned off for some time, fuel injector operation can differ as compared to when the engine is warmed up. Engineers are always searching for ways to improve fuel system operation and performance, and various strategies have been proposed over the years for electronic injector control to address temperature-affected properties, as well as various hardware solutions. International Patent Application No. WO200039443A1 to Stockner et al. is directed to an apparatus and method for a cold start timing sweep. In Stockner et al. temperature of the engine is sensed, and an engine temperature signal indicative of temperature of actuating fluid used to actuate a fuel injector is generated. A desired piston-firing position is determined, and an injection command signal generated. Apparently the injection command signal oscillates in a time range that is a function of the temperature.

Summary

In one aspect, an engine head assembly includes an engine head, and a double-walled fuel connector assembly forming a high-pressure fuel supply passage and a low-pressure return passage. The engine head assembly further includes a fuel injector supported in the engine head and including an injector housing having formed therein a fuel inlet fluidly connected to the high-pressure fuel supply passage, and a fuel outlet, a direct-operated nozzle check, and an injection control valve assembly. A low-pressure space is defined between the injector housing and the engine head, and fluidly connects the fuel outlet to the low-pressure fuel return passage.

In another aspect, a fuel system includes a fuel injector having an injector housing defining a longitudinal axis and including a nozzle case having a cooling fuel outlet, an injector body threaded engaged with the nozzle case and including a fuel inlet and a connector seat extending circumferentially around the fuel inlet, and a stack including a tip piece having a plurality of spray orifices and an orifice piece clamped between the injector body and the tip piece and having a control valve seat. The fuel system further includes an injection control valve assembly including a control valve movable to open and close the control valve seat, and a direct-operated nozzle check movable to open and close the plurality of spray orifices. A high-pressure fuel inlet path extends, between the fuel inlet and the plurality of spray orifices, through the injector body, and a low-pressure cooling fuel outlet path extends, between the injection control valve seat and the cooling fuel outlet, through a first clearance defined between the injector body and the orifice piece and a second clearance defined between the stack and the nozzle case.

In still another aspect, a method of operating a fuel system includes feeding a fuel through a fuel supply passage in a fuel connector to a fuel injector, and opening a control valve seat for an injection control valve to expel fuel through the control valve seat from a check control chamber for a nozzle check in the fuel injector. The method further includes conveying the fuel expelled through the control valve seat to a fuel outlet formed in a nozzle case of the fuel injector, and dissipating heat of the fuel injector to the expelled fuel conveyed to the fuel outlet. The method further includes limiting a temperature difference between material of the fuel injector at a first location and material of the fuel injector at a second location based on the dissipating heat of the fuel injector, and conveying the expelled fuel to a fuel return passage formed at least in part by the fuel connector.

DETAILED DESCRIPTION

Figure 1:
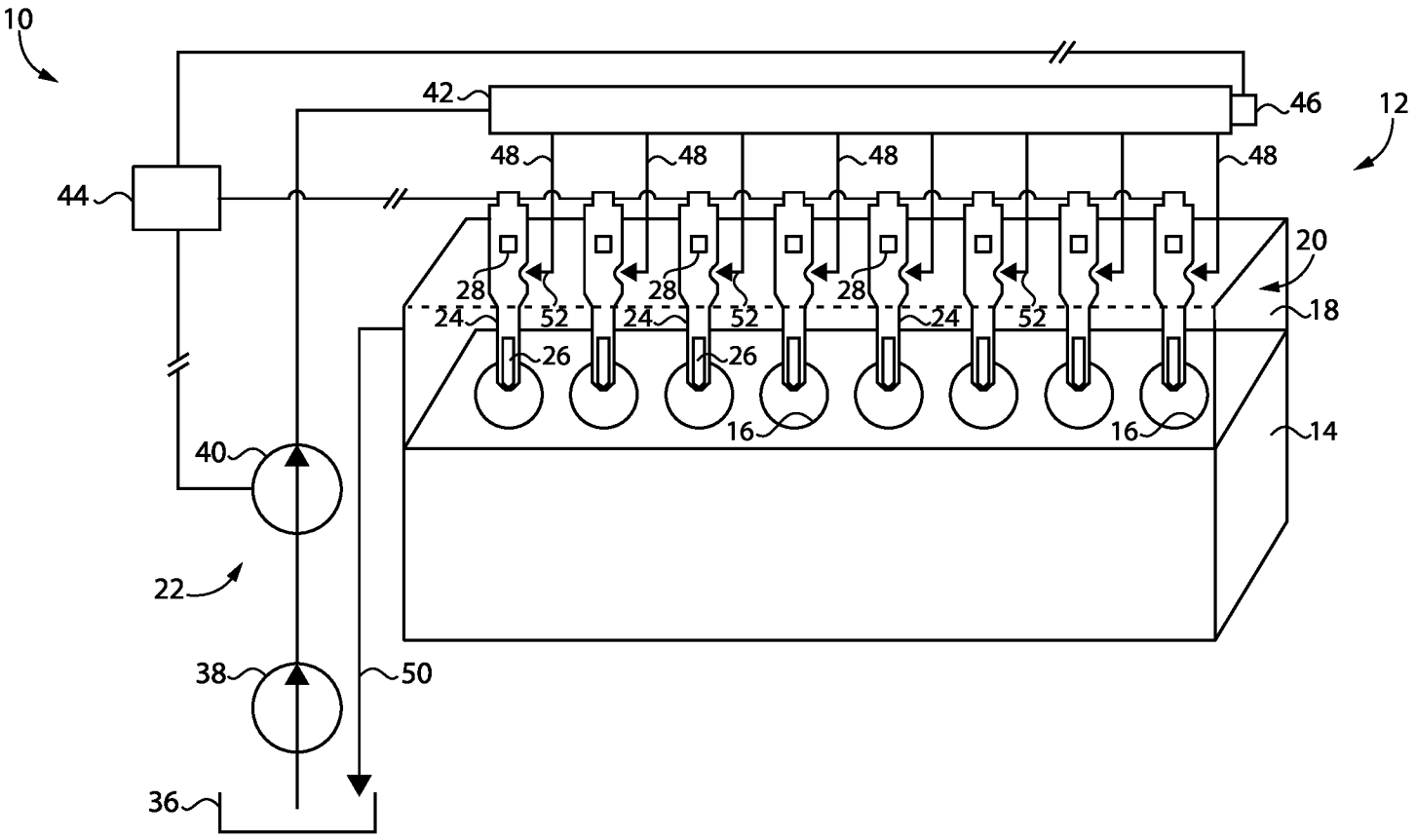
FIG. 1 is a diagrammatic view of an internal combustion engine system, according to one embodiment.

Referring to FIG. 1, there is shown an internal combustion engine system 10, according to one embodiment. Engine system 10 includes an engine 12 having a cylinder block 14 with a plurality of combustion cylinders 16 formed therein. Pistons will be positioned within cylinders 16 and movable in a generally conventional manner to rotate a crankshaft. Cylinders 16 can include any number in any suitable arrangement such as an in-line pattern, a V-pattern, or still another. Engine system 10 can be applied for a wide range of applications including powering a drive line in a vehicle, operating a pump or a compressor, or rotating an electrical generator to name a few examples.

Engine 12 also includes an engine head 18. Engine head 18 is attached to cylinder block 14 and can include a one-piece engine head or individual engine head sections, for example. Engine system 10 also includes a fuel system 22. Fuel system 22 includes a plurality of fuel injectors 24 each positioned in engine head 18 and extending into one of cylinders 16 to directly inject a pressurized fuel. In an implementation engine 12 includes a compression-ignition engine operable on a suitable compression-ignition fuel such as a diesel distillate fuel. Fuel system 22 also includes a fuel supply or tank 36, a low-pressure transfer pump 38, and a high-pressure pump 40 that pressurizes fuel to an injection pressure and feeds the same to a pressurized fuel reservoir or common rail 42. A plurality of feed lines 48 extend from common rail 42 to engine head 18 to supply the pressurized fuel to fuel injectors 24 as further discussed herein. A low-pressure return line 50 extends from engine head 18 back to fuel tank 36. Fuel system 22 can be electronically controlled and includes a suitable computerized electronic control unit 44 and a pressure sensor 46 structured to monitor a fuel pressure in common rail 42. Electronic control unit 44 may receive inputs from pressure sensor 46 and output control signals, such as electrical control currents, to solenoid actuators in fuel injectors 24, for example. Each fuel injector 24 includes an injection control valve assembly 28 and a direct-operated nozzle check 26. Injection control valve assemblies 28 and direct-operated nozzle checks 26, hereinafter referred to at times in the singular, are conventionally operated to open and close to control a start of injection and an end of injection according to well-known principles.

Figure 2:
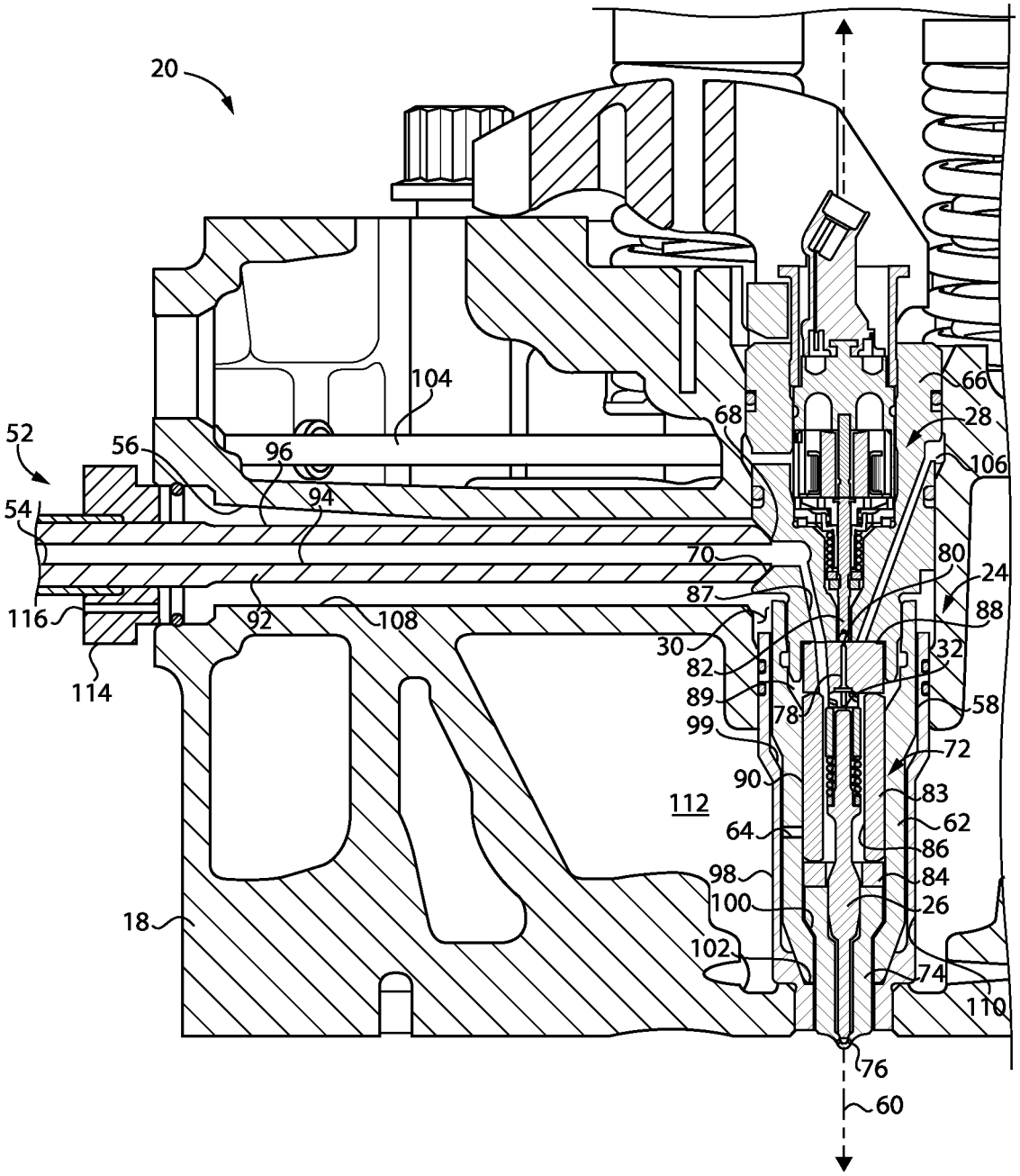
FIG. 2 is a sectioned side diagrammatic view of an engine head assembly, according to one embodiment.

Referring also now to FIG. 2, engine head 18 forms, together with one or more of fuel injectors 24 supported in engine head 18, and one or more double-walled fuel connector assemblies 52, an engine head assembly 20. Each double-walled fuel connector assembly 52, hereinafter referred to at times in the singular, forms a high-pressure fuel supply passage 54 and a low-pressure fuel return passage 56. Each fuel injector 24, also referred to hereinafter at times in the singular, is supported in engine head 18 and includes an injector housing 58 defining a longitudinal axis 60 and including a nozzle case 62 having a cooling fuel outlet 64, and an injector body 66 threaded engaged with nozzle case 62 and having formed therein a fuel inlet 68 and a connector seat 70 extending circumferentially around fuel inlet 68. Those skilled in the art will be familiar with the technique of threading or screwing an injector body to a nozzle case to secure components therebetween. In the illustrated embodiment injector body 66 may be externally threaded and nozzle case 62 internally threaded. Injector housing 58 further includes a stack 72 including a tip piece 74 having a plurality of spray orifices 76 formed therein and an orifice piece 78 clamped between injector body 66 and tip piece 74 and having an injection control valve seat 80 formed therein. As noted above, each fuel injector 24 includes an injection control valve assembly 28. Injection control valve assembly 28 may include an injection control valve 82 movable to open and close control valve seat 80. Injection control valve 82 may include a pin, a rod, a ball valve, a flat disc valve, a flat-sided ball valve, or combinations of these. Stack 72 may also include a first spacer 83 and a second spacer 84 clamped between orifice piece 78 and tip piece 74. Direct-operated nozzle check 26 is movable, partially within a nozzle chamber 86 formed by spaces 83, by controlling a closing hydraulic pressure in a control chamber 32 acting on a closing hydraulic surface of direct-operated nozzle check 26 via actuating injection control valve 82.

As can also be seen from FIG. 2, a high-pressure fuel inlet path 87 extends, between fuel inlet 68 and spray orifices 76, through injector body 66. A low-pressure cooling fuel outlet path 89 extends, between injection control valve seat 80 and cooling fuel outlet 64, through a first clearance 88 defined between injector body 66 and orifice piece 78 and through a second clearance 90 defined between stack 72 and nozzle case 62. As can also be seen from FIG. 2, high-pressure fuel inlet path 87 extends through nozzle chamber 86. Low-pressure cooling fuel outlet path 89 extends radially between spacer 83 and nozzle case 62.

As illustrated in FIG. 2, engine head 18 has a connector bore 108 formed therein and an injector bore 110 intersecting connector bore 108. A coolant cavity 112 is formed in engine head 18 and contains a coolant, such as engine coolant, water, mixtures, et cetera, that is conveyed through engine head 18 in contact with an injector sleeve 98. A low-pressure space 30 is defined between injector housing 58 and engine head 18, and fluidly connects fuel outlet 64 to low-pressure return passage 56. A fuel drain path 99 from fuel outlet 64 to low-pressure space 30 is formed radially between injector sleeve 98 and nozzle case 62. A location of fuel outlet 64 may be variable. In the illustrated embodiment fuel outlet 64 is located axially between second spacer 84 and orifice piece 78, radially outward of first spacer 83. A first metal-to-metal seal 100 is formed between tip piece 74 and nozzle case 62, and a second metal-to-metal seal 102 is formed between nozzle case 62 and injector sleeve 98. Fuel outlet 64 is axially between metal-to-metal seal 102 and injection control valve assembly 28.

As noted above, double-walled fuel connector assembly 52 extends into engine head 18, and in the illustrated embodiment is formed in part by engine head 18. Fuel connector assembly 52 may include a quill connector 92 clamped in sealing contact with injector housing 58 in contact with connector seat 70. Quill connector 92 may be elongate, and includes an inner surface 94 forming high-pressure fuel supply passage 54 and fluidly connected to fuel inlet 68. Quill connector 92 may also include an outer surface 96 forming a wetted wall of low-pressure fuel return passage 56. In this arrangement the fuel supply passage is formed as an inner passage and the fuel return passage is formed as an outer passage. In other embodiments side-by-side parallel passages could be used, or the inner and outer functionality could be reversed. A fitting 114 secures quill connector 92 in place. A drain passage 116 extends through fitting 114 and can drain fuel from low-pressure return passage 56 back to fuel tank 36 by way of drain line 50. Another low-pressure fuel line is shown at 104 and is fluidly connected to a low-pressure port 106 in injector body 66. Low-pressure fuel line 104 and low-pressure port 106 may or may not be used in various embodiments.

Figure 3:
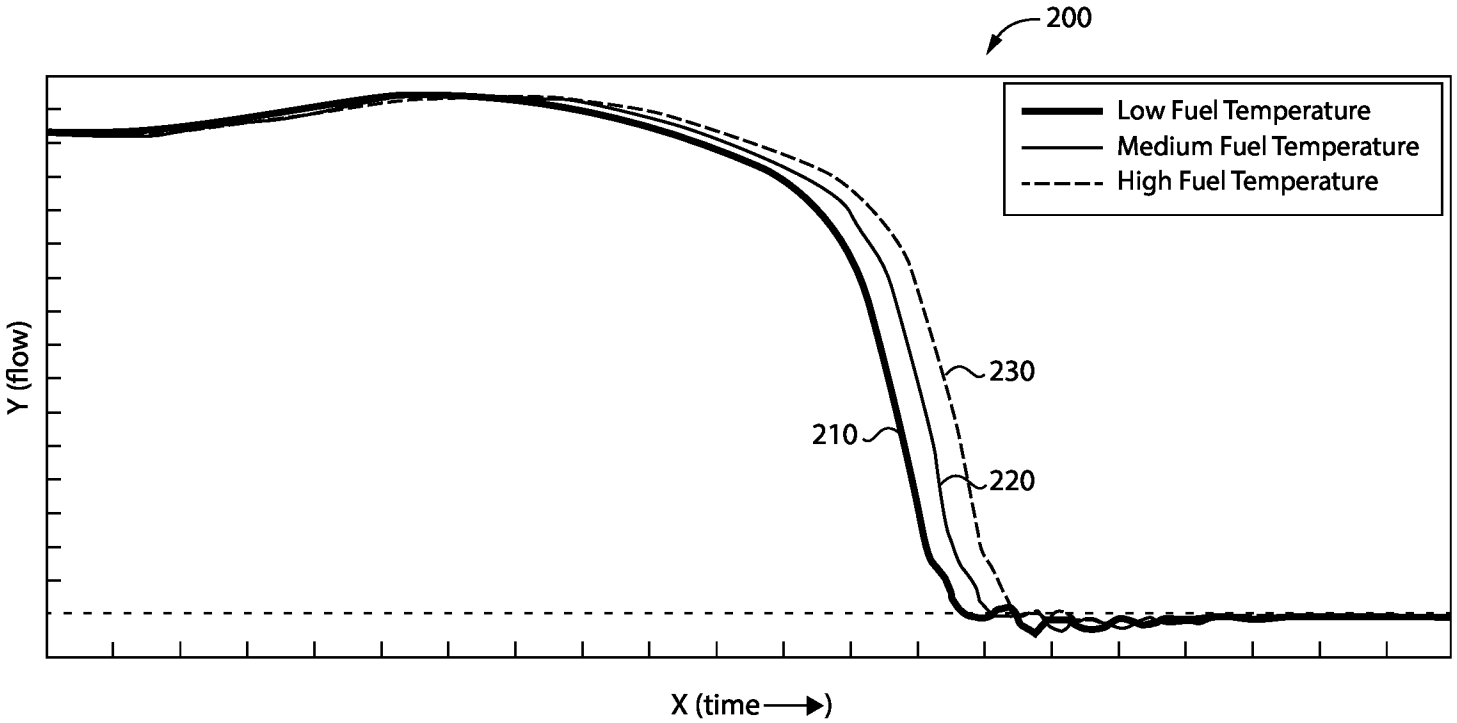
FIG. 3 is a graph illustrating temperature-affected fuel injection properties, according to one embodiment.

Referring now to FIG. 3, there is shown a graph 200 illustrating fuel injector operation at a low fuel temperature 210, at a medium fuel temperature 220, and at a high fuel temperature 230. Fuel flow is shown on the Y-axis, and time on the X-axis. It can be seen from FIG. 3 that a fuel flow through a fuel injector varies with fuel temperature. Fuel viscosity as well as potentially other factors such as the size of clearances between components can change with temperature, potentially leading to variability or unpredictability in fuel injector performance. Such variability or unpredictability may particularly be observed during cold start conditions where different parts of the injector are at different temperatures. As further discussed herein, the present disclosure provides strategies for mitigating variability or unpredictability in injector performance by way of limiting such temperature differences.

Industrial Applicability

Referring to the drawings now generally, operating fuel system 22 can include feeding a fuel through high-pressure fuel supply passage 54 in quill connector 92 to fuel injector 24. At an appropriate time control valve seat 80 for injection control valve 82 can be opened to expel fuel through control valve seat 80 from check control chamber 32. The fuel expelled through control valve seat 80 can flow through first clearance 88 and through second clearance 90 to fuel outlet 64 formed in nozzle case 62. Flow of the cooling fuel dissipates heat of fuel injector 24, and the cooling fuel thenceforth making its way according to the pathways discussed herein to low-pressure fuel return passage 56 and out of engine head assembly 20.

During certain conditions, and particularly when engine 12 is cold started, temperatures at one part of fuel injector 24 can increase faster than at other parts of fuel injector 24. It is believed that injection control valve assembly 28, and/or materials of injector housing 58 in proximity to injection control valve assembly 28, can increase in temperature relatively more rapidly than temperatures of materials at other locations in fuel injector 24, such as locations in tip piece 74 and/or nozzle check 26. Forcing of a flow of fuel through relatively small orifices in orifice piece 78 may cause material at that location to increase in temperature relatively more rapidly than material at other locations. Regardless of the specific root cause, it is believed that thermal expansion differences at different locations in the fuel injector can lead to performance variability, particularly associated with an end of injection as can be envisioned from FIG. 3. In certain prior strategies no specific displacement of fuel out of a nozzle case or tip region of a fuel injector is provided for. Thus, while low-pressure fuel may fill certain of the spaces and clearances around injector components, that low-pressure fuel is induced to flow very little or not at all. The present disclosure provides a positive outflow path for fuel from such regions, thereby limiting a temperature difference between material of the fuel injector at a first location and material of the fuel injector at a second location by way of dissipating heat to the fuel conveyed through low-pressure cooling fuel outlet path 89. The fuel flow strategies contemplated herein may also assist in flushing debris out of a fuel injector.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine head assembly comprising:

an engine head;

a double-walled fuel connector assembly forming a high-pressure fuel supply passage and a low-pressure fuel return passage;

a fuel injector supported in the engine head and including an injector housing having formed therein a fuel inlet fluidly connected to the high-pressure fuel supply passage, and a fuel outlet, a direct operated nozzle check, and an injection control valve assembly; and a low-pressure space is defined between the injector housing and the engine head, and fluidly connects the fuel outlet to the low-pressure fuel return passage.

2. The engine head assembly of claim 1 wherein the double-walled fuel connector assembly includes a quill connector clamped in sealing contact with the injector housing.

3. The engine head assembly of claim 2 wherein the quill connector includes an inner surface forming the high-pressure fuel supply passage, and an outer surface forming the low-pressure fuel return passage together with the engine head.

4. The engine head assembly of claim 1 wherein the injector housing includes a nozzle case, and the fuel outlet is formed in the nozzle case.

5. The engine head assembly of claim 4 further comprising an injector sleeve within the engine head, and a fuel drain path from the fuel outlet to the low-pressure space is formed between the injector sleeve and the nozzle case.

6. The engine head assembly of claim 5 wherein the injector housing defines a longitudinal axis, and the fuel drain path is formed radially between the injector sleeve and the nozzle case.

7. The engine head assembly of claim 5 wherein a metal-to-metal seal is formed between the injector housing and the nozzle case, and the fuel outlet is located axially between the metal-to-metal seal and the injection control valve assembly.

8. The engine head assembly of claim 5 wherein:

the injector housing further includes an injector body having a connector seat extending circumferentially around the fuel inlet, a spacer, and an orifice piece clamped between the injector body and the spacer; and the orifice piece includes a control valve seat formed therein, and a clearance is defined between the injector body and the orifice piece and fluidly connects the control valve seat to the fuel outlet.

9. A fuel system comprising:

a fuel injector including an injector housing defining a longitudinal axis and including a nozzle case having a cooling fuel outlet, an injector body threaded engaged with the nozzle case and including a fuel inlet and a connector seat extending circumferentially around the fuel inlet, and a stack including a tip piece having a plurality of spray orifices and an orifice piece clamped between the injector body and the tip piece and having an injection control valve seat;

an injection control valve assembly including a control valve movable to open and close the control valve seat;

a direct-operated nozzle check movable to open and close the plurality of spray orifices;

a high-pressure fuel inlet path extends, between the fuel inlet and the plurality of spray orifices, through the injector body; and a low-pressure cooling fuel outlet path extends, between the injection control valve seat and the cooling fuel outlet, through a first clearance defined between the injector body and the orifice piece and a second clearance defined between the stack and the nozzle case.

10. The fuel system of claim 9 further comprising a quill connector including an inner surface forming a high-pressure fuel supply passage fluidly connected to the fuel inlet.

11. The fuel system of claim 10 wherein the quill connector includes an outer surface forming a wetted wall of a low-pressure fuel return passage.

12. The fuel system of claim 11 further comprising a fuel supply, a high-pressure pump, a pressurized fuel reservoir fluidly connected to the high-pressure pump and to the high-pressure fuel supply passage, and a fuel return conduit extending between the quill connector and the fuel supply.

13. The fuel system of claim 9 wherein:

the stack further includes a spacer clamped between the orifice piece and the tip piece and forming a nozzle chamber;

the high-pressure fuel inlet path extends through the nozzle chamber; and the low-pressure cooling fuel outlet path extends between the spacer and the nozzle case.

14. The fuel system of claim 9 further comprising an injector sleeve, and a fuel drain path from the fuel outlet formed between the injector sleeve and the nozzle case.

15. A method of operating a fuel system comprising:

feeding a fuel through a fuel supply passage in a fuel connector to a fuel injector;

opening a control valve seat for an injection control valve to expel fuel through the control valve seat from a check control chamber for a nozzle check in the fuel injector;

conveying the fuel expelled through the control valve seat to a fuel outlet formed in a nozzle case of the fuel injector;

dissipating heat of the fuel injector to the expelled fuel conveyed to the fuel outlet;

limiting a temperature difference between material of the fuel injector at a first location and material of the fuel injector at a second location based on the dissipating heat of the fuel injector; and conveying the expelled fuel to a fuel return passage formed at least in part by the fuel connector.

16. The method of claim 15 wherein the feeding a fuel includes feeding a fuel pressurized to an injection pressure, and further comprising opening the nozzle check in the fuel injector based on the opening a control valve seat to inject the fuel at the injection pressure into a cylinder in an engine.

17. The method of claim 15 wherein the fuel connector includes a quill connector supported in an engine head, and the low-pressure fuel return passage is formed between an outer surface of the quill connector and an inner surface of the engine head.

18. The method of claim 15 wherein the fuel outlet is formed in a nozzle case of the fuel injector.

19. The method of claim 18 wherein the conveying the fuel expelled through the control valve seat includes conveying the fuel in a low-pressure cooling fuel outlet path extending, between the injection control valve seat and the cooling fuel outlet, through a first clearance defined between an injector body and an orifice piece including the control valve seat, and a second clearance defined between a stack and the nozzle case.

20. The method of claim 18 further comprising conveying the fuel expelled through the fuel outlet between the nozzle case and an injector sleeve to the fuel return passage.

* * * * *